United States Patent [19]

Strange

[11] 4,332,282

[45] Jun. 1, 1982

[54] MEANS AND METHOD OF RECLAIMING CRANKCASE OIL

[76] Inventor: Roger W. Strange, 11510 Poblado, San Diego, Calif. 92127

[21] Appl. No.: 186,678

[22] Filed: Sep. 12, 1980

[51] Int. Cl.[3] ..... B65B 3/04

[52] U.S. Cl. ..... 141/1; 141/98; 184/1.5; 184/105 R; 184/106; 206/229; 222/83.5; 222/566; 220/200

[58] Field of Search ..... 141/98, 329, 330, 363, 141/364, 365, 366, 1-12, 325-327; 222/83.5, 86, 88, 460, 566-575, 108, 192, 109, 110, 111; 184/1.5, 106, 105 R; 220/200; 206/223, 229

[56] References Cited

U.S. PATENT DOCUMENTS 117,723 8/1871 Baker ..... 141/98

884,489 4/1908 Hanson ..... 141/98

*Primary Examiner*—Houston S. Bell

*Attorney, Agent, or Firm*—Ralph S. Branscomb

[57] ABSTRACT

A technique for both cleaning up the crankcase oil changing process and recycling the oil for use as heating oil or, after refining, as lubricating oil, utilizes a shallow pan with a funnel defined on one edge which captures used oil from the engine crankcase, an oil can opener spout which makes a circular hole in the top of the oil can from which the fresh oil is poured into the crankcase after the used oil is drained, and a series of plugs which are inserted into the openings made by the oil can opener spout so that the used crankcase oil can be poured back into the cans the new oil came in by utilization of the special oil drip pan with the funnel extension.

6 Claims, 7 Drawing Figures

MEANS AND METHOD OF RECLAIMING CRANKCASE OIL

BACKGROUND

Up until recently petroleum products were sufficiently inexpensive that although engine oil is sometimes recycled when collected at a service station, no serious thought was given to recycling used crankcase oil when changed by the home mechanic. The current high prices of petroleum products however was made the prospect of saving crankcase oil either to be re-refined and used again as crankcase oil or simply used as heating oil, more practical. In fact many stoves which have been developed in the last few years to accommodate a variety of different fuels advertise that they can use used crankcase oil without clogging.

Aside from the conversation aspects of recycling oil and the possibility of saving money, it is common knowledge that the oil changing operation is an unpleasant and messy job which ends up in several quarts of oil lying in an oil change pan with no place to put it. Typical solutions involve trying to pour the oil into plastic gallon milk containers or just dumping it in a hole one has in the backyard. Dumping becomes increasingly impractical with increased housing density and condominium living, and in any event more often than not, no matter how the job is done, some of the oil will have slopped into the pavement or onto elaborately arrayed newspapers put under the car to protect the pavement.

SUMMARY

The present invention is a dual purpose means and method of changing the crankcase oil which both eliminates the mess and results in the used oil being neatly packaged in the quart cans that the new oil came in.

The apparatus used in the technique involves an oil collection pan somewhat resembling a frying pan with a funnel coming off the side terminating in a valved spout. Preferably a second valve is disposed upstream in the funnel from the first valve so that when the oil is into the cans, a charge of oil equaling one quart can be loaded into the spout between the valves for discharge into a quart can so that overflow is eliminated.

The fresh oil is opened by means of a combination spout and a can opener similar to those typically in use except that the hole created in the can is circular to accommodate a circular plastic plug.

The procedure for use of this apparatus involves, first, emptying the used oil into the collecting pan, then puncturing all of the new oil cans with the special spout and emptying them into the crankcase, and then by utilizing the funnel side of the collector container refilling all of the empty cans and sealing them with a circular plastic plug.

DETAILED DESCRIPTION OF THE PREFERRED EMBODIMENT

Figure 1:
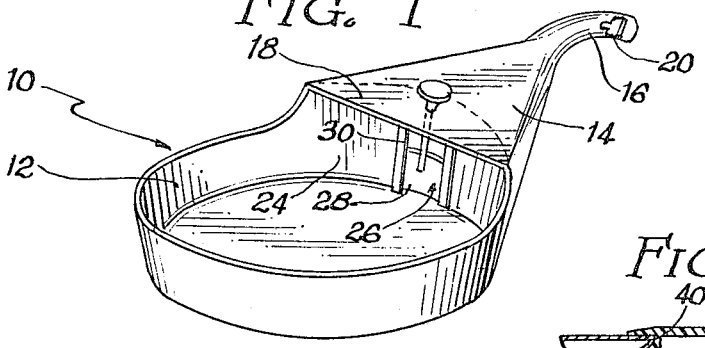
FIG. 1 is a perspective view of the oil collection container.
Figure 7:
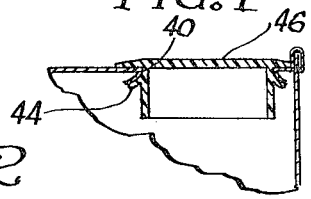
FIG. 7 is a section taken along lines 7—7 of FIG. 4.
Figure 2:
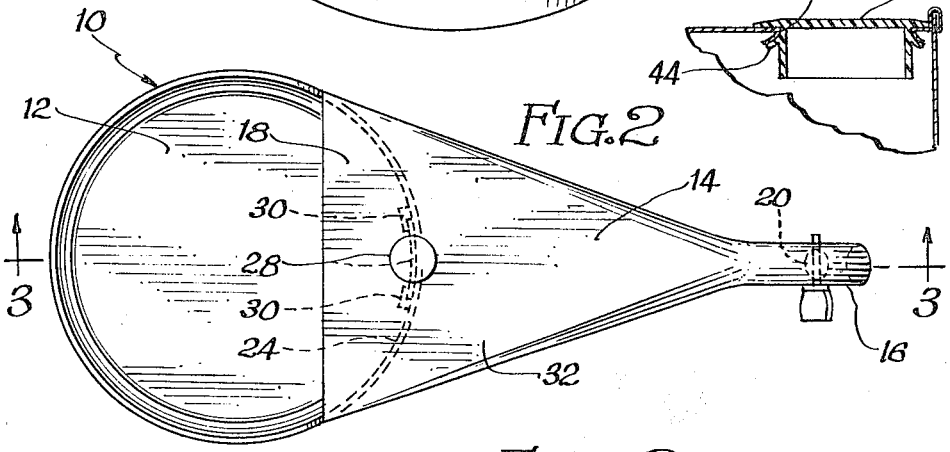
FIG. 2 is a top elevation view of the container of FIG. 1 showing portions in phantom.
Figure 3:
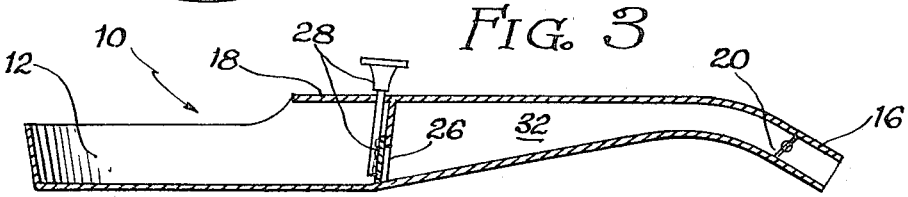
FIG. 3 is a section taken along Line 3—3 of FIG. 2.
Figure 4:
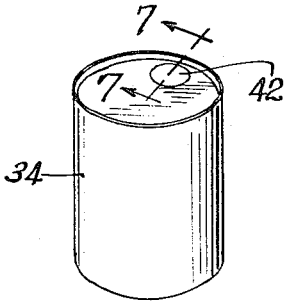
FIG. 4 is a top elevation view of an oil can with a plug therein.
Figure 5:
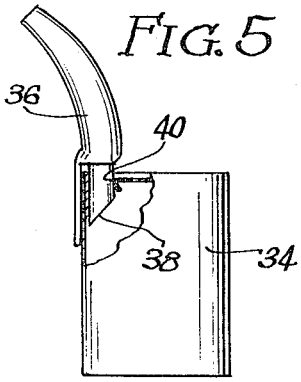
FIG. 5 is a side elevation view partially in section showing the spout inserted into the oil can.

The first stage of the oil changing process involves removal of the used crankcase oil which of course is done by unscrewing the plug at the bottom of the oil pan and permitting the oil to drip into the specially designed receiver container 10 which has a flat pan portion 12 and a funnel portion 14 extending from one side of the pan. The funnel may taper upwardly as shown into an arcuate snout 16 sufficiently elevated to reatin oil when the pan is lying flat. The wide end of the funnel 14 expands at 18 to define a partial lid over one edge of the pan to facilitate pouring the used oil from the pan.

The interior of the funnel maybe open but in the preferred embodiment illustrated is fitted at its tip end with a first valve 20. Toward the wide end the interior is substantially isolated from the pan by means of the curved pan wall 24 which has a central port 26 which may be at least partially opened by raising the gate valve 28 which slides in tracks 30. The volume of area 32 defined in the funnel should be one quart so that when fully charged with oil will just fill an empty quart can.

The fresh oil cans represented at 34 are opened by forcing into the top of the oil can opener snout 36 which has a cutting edge such as at 38 which makes a circular hole 40 to accommodate a circular plug 42. This plug preferably has detents 44 to retain itself in the hole and a top sealing flap 46 which is pressed down tightly onto the top surface of the can to seal it regardless of the inevitable irregularities which would occur in the planform of the opening 40.

Figure 6:
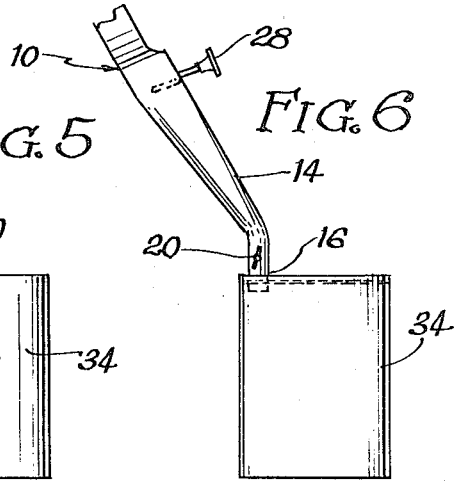
FIG. 6 is a side elvation view showing the filling process of the emptied oil cans.

Once the used oil from the crankcase has been completely emptied, the container 10 may be pulled from beneath the vehicle by the snout 16 which doubles as a handle. Once the new oil cans have been emptied, the used oil can be poured through the holes in the cans as shown in FIG. 6. The diameter of the snout 16 is slightly less than the hole 40 to facilitate this filling.

Naturally the pan must be held at a slant for the oil to drain out. Although not shown in the preferred embodiment, the container 10 could also incorporate collapsible legs to automatically position it in the proper orientation and height for the snout to be in the approximate position shown in FIG. 6. Otherwise, naturally someone is going to be required to hold the container while it is draining.

As can be visualized from FIG. 6, by the sequential operation of the two valves 20 and 22 one quart of used oil can be sequentially loaded into the funnel and discharged to precisely fill up an oil can, and the process repeated until all the oil has been containerized.

What is claimed is:

1. An oil changing kit comprising:

(a) a flattened open-topped container;

(b) a funnel extending from one side of said container and communicating with the interior thereof and dfines a partial lid for said container to catch otherwise spilled oil when said container is tilted toward said spout, whereby said container can be filled from a crankcase and drained into oil cans through said funnel; and (c) said funnel having a spout with a first valve in the tip thereof.

2. Structure according to claim 1 wherein said funnel has a second valve spaced toward the container from said first valve to define a metered volume therebetween.

3. A method for reclaiming crankcase oil comprising the following steps:

(a) draining the used oil from the crankcase into a container;

(b) cutting a hole in a sufficient number of fresh oil cans to fill the crankcase;

(c) pouring fresh oil from said cans into said crankcase;

(d) pouring used oil from said container into said cans; and (e) plugging the holes in said cans.

4. A method according to claim 3 wherein said container has an integral funnel with a spout and step (d) includes filling said cans through said spout.

5. A method according to claim 4 wherein said funnel includes two spaced valves defining a volume therebetween no larger than the volume of one of said cans and step (d) includes first filling said funnel with a charge of used oil from said container and then discharging said charge by releasing the valve nearest the tip of said funnel.

6. A method according to claim 3 wherein step (b) is accomplished with an oil can opener spout which cuts a circular hole in a can and step (e) comprises pressing pre-formed circular plugs into the circular holes so cut in said cans.

* * * * *

REEXAMINATION CERTIFICATE (115th)

United States Patent [19]

Strange

[11] B1 4,332,282

[45] Certificate Issued Aug. 16, 1983

[54] MEANS AND METHOD OF RECLAIMING CRANKCASE OIL

[76] Inventor: Roger W. Strange, 11510 Poblado, San Diego, Calif. 92127

Reexamination Request:
No. 90/000,248, Aug. 30, 1982

Reexamination Certificate for:

| | |
|---|---|
| Patent No.: | **4,332,282** |
| Issued: | **Jun. 1, 1982** |
| Appl. No.: | **186,678** |
| Filed: | **Sep. 12, 1980** |

[51] Int. Cl.[3] ..... B65B 3/04

[52] U.S. Cl. ..... 141/1; 141/98; 184/1.5; 184/105 R; 184/106; 206/229; 222/83.5; 222/566; 220/200

[58] Field of Search ..... 141/1, 98, 311 R, 319-322, 141/325-327, 329, 331, 333, 334, 339, 344, 345, 363-366; 184/1.5, 105 R; 206/223; 220/1 C; 222/108-111, 450, 454, 457, 462; 137/572

[56] References Cited

U.S. PATENT DOCUMENTS

| | | | |
|---|---|---|---|
| 117,723 | 8/1871 | Baker | 141/98 |
| 752,459 | 2/1904 | Matthews | 222/450 X |
| 884,489 | 4/1908 | Hanson | 141/98 |
| 1,223,207 | 4/1917 | Scypinski | 222/450 |
| 3,088,631 | 5/1963 | Lien et al. | 222/570 |
| 3,442,377 | 5/1969 | Angelus | 220/352 |
| 3,659,738 | 5/1972 | Friedmann et al. | 220/356 |
| 4,084,655 | 4/1978 | Savron | 184/106 |
| 4,114,660 | 9/1978 | Arruda | 184/106 |
| 4,296,838 | 10/1981 | Cohen | 206/223 |

*Primary Examiner*—Stephen Marcus

[57] ABSTRACT

A technique for both cleaning up the crankcase oil changing process and recycling the oil for use as heating oil or, after refining, as lubricating oil, utilizes a shallow pan with a funnel defined on one edge which captures used oil from the engine crankcase, an oil can opener spout which makes a circular hole in the top of the oil can from which the fresh oil is poured into the crankcase after the used oil is drained, and a series of plugs which are inserted into the openings made by the oil can opener spout so that the used crankcase oil can be poured back into the cans the new oil came in by utilization of the special oil drip pan with the funnel extension.

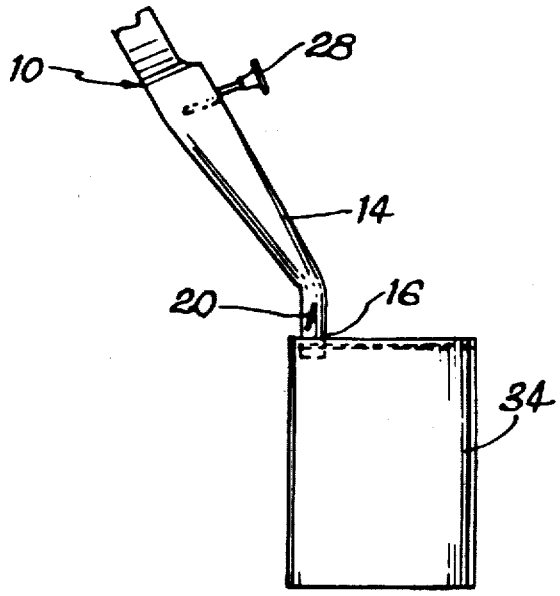

REEXAMINATION CERTIFICATE ISSUED UNDER 35 U.S.C. 307.

MEANS AND METHOD OF RECLAIMING CRANKCASE OIL

THE PATENT IS HEREBY AMENDED AS INDICATED BELOW.

AS A RESULT OF REEXAMINATION, IT HAS BEEN DETERMINED THAT:

Claims 1–6 having been finally determined to be unpatentable, are cancelled.

* * * * *